US011254479B2

(12) United States Patent
DiBerardino et al.

(10) Patent No.: US 11,254,479 B2
(45) Date of Patent: Feb. 22, 2022

(54) LID FOR A STORAGE CONTAINER

(71) Applicant: HIGH & MIGHTY ENTERPRISES, LLP, Lake Worth, FL (US)

(72) Inventors: Paul DiBerardino, Lake Worth, FL (US); Stephen R. Barrese, Huntington, NY (US)

(73) Assignee: HIGH & MIGHTY ENTERPRISES, LLP, Lake Worth, FL (US)

( * ) Notice: Subject to any disclaimer, the term of this patent is extended or adjusted under 35 U.S.C. 154(b) by 84 days.

(21) Appl. No.: 16/814,073

(22) Filed: Mar. 10, 2020

(65) Prior Publication Data

US 2021/0284405 A1 Sep. 16, 2021

(51) Int. Cl.
*B65D 51/24* (2006.01)
*B65D 81/20* (2006.01)

(52) U.S. Cl.
CPC ..... *B65D 51/245* (2013.01); *B65D 81/2015* (2013.01)

(58) Field of Classification Search
CPC ..... B65D 51/245; B65D 51/1644; B65D 51/1672; B65D 51/1683; B65D 81/2015; B65D 81/2007; B65D 53/02; A47G 19/2272; B01D 11/0203; A47J 27/09; Y10T 137/7922
See application file for complete search history.

(56) References Cited

U.S. PATENT DOCUMENTS 2,037,731 A * 4/1936 Mobley ..... B65D 90/34 220/748
4,214,474 A * 7/1980 Bleidt ..... G01L 7/048 73/30.04
5,323,731 A * 6/1994 Kalowski ..... G01L 19/12 116/266

(Continued)

FOREIGN PATENT DOCUMENTS

CH 660576 A * 5/1987
DE 724436 C * 8/1942 ..... B65D 81/2015
DE 29605382 U1 * 5/1996 ..... B65D 81/2007

OTHER PUBLICATIONS

Herbal Infusers. (Jun. 26, 2017). Might Fast Herbal Infuser With Mighty Safe Vacuum Vault, amazon.ca. • https://www.amazon.ca/Fast-Herbal-Infuser-Mighty-Vacuum/dp/B071JCRTVT. Jun. 2017 (Year: 2017).*

(Continued)

*Primary Examiner* — J. Gregory Pickett
*Assistant Examiner* — Abigail Elizabeth Guidry
(74) *Attorney, Agent, or Firm* — Dilworth & Barrese, LLP

(57) ABSTRACT

There is provided herein a lid for a vacuum storage container, which contains a lid body having a top side and an opposing bottom side, the lid comprising a pressure-release valve having a vacuum-sealed position and a vacuum-release position, and a collar on the bottom side of the lid body having an open end, the pressure-release valve extend- (Continued)

ing from the top side of the lid body into the collar on the bottom side, and a sheath covering the open end of the collar on the bottom side, which sheath reduces a vacuum loss when the pressure-release valve is in the vacuum-sealed position while permitting a release of vacuum when the pressure-release valve is in the vacuum-release position.

11 Claims, 11 Drawing Sheets

(56) References Cited

U.S. PATENT DOCUMENTS

| | | | | |
|---|---|---|---|---|
| 7,013,833 | B2 * | 3/2006 | Lemberger | B60C 23/0496 116/266 |
| 7,621,416 | B2 * | 11/2009 | Bursztein | B65D 43/0218 220/231 |
| 8,201,691 | B1 * | 6/2012 | Chowdhury | A61J 1/03 206/534 |
| 8,888,752 | B2 * | 11/2014 | Cacka | A61M 3/0208 604/278 |
| 10,037,640 | B2 | 7/2018 | Gordon | |
| 10,065,773 | B2 * | 9/2018 | Seidler | A47G 19/2272 |
| 10,562,690 | B2 * | 2/2020 | Plazarte | B65D 43/0202 |
| 2003/0141270 | A1 * | 7/2003 | Yang | B65D 51/1683 215/228 |
| 2004/0084450 | A1 * | 5/2004 | Havens | B65D 51/1644 220/203.07 |
| 2006/0138068 | A1 * | 6/2006 | Tsai | B65B 31/047 215/228 |
| 2009/0120939 | A1 * | 5/2009 | Wang | B65D 51/1683 220/361 |
| 2011/0197685 | A1 * | 8/2011 | Alburty | G01N 1/4055 73/863.23 |
| 2012/0130316 | A1 * | 5/2012 | Boyd | A61M 5/24 604/189 |
| 2014/0339223 | A1 * | 11/2014 | Backaert | A47J 27/09 219/732 |
| 2016/0230905 | A1 * | 8/2016 | Cannon, Jr. | F16K 31/58 |
| 2017/0329031 | A1 * | 11/2017 | Collins | E21B 49/00 |
| 2018/0127180 | A1 * | 5/2018 | Gordon | G07C 9/33 |
| 2018/0134538 | A1 * | 5/2018 | Kim | B67D 1/001 |
| 2018/0273274 | A1 * | 9/2018 | Ho | A47J 47/10 |
| 2020/0189829 | A1 * | 6/2020 | Han | B65D 7/065 |
| 2020/0317411 | A1 * | 10/2020 | Reiley | B65D 51/24 |

OTHER PUBLICATIONS

YouTube. (2017). Mighty Safe Vacuum Vault—Herbal Vacuum Sealer. YouTube. https://www.youtube.com/watch?v=amBO4bwrDDg. Jun. 2017 (Year: 2017).*

* cited by examiner

LID FOR A STORAGE CONTAINER

BACKGROUND

1. Field of the Invention

The present application is directed to a storage container, more specifically a lid for a storage container.

2. Background of the Art

Storage of various products such as food or tobacco can be improved by keeping the products in a container under vacuum. Keeping the products in a container under vacuum helps to protect the products from certain microorganisms and pests, as well as mold and fungus growth. Furthermore, keeping the products in a container under vacuum helps prevent the products from oxidizing, thereby maintaining the desired moisture level and aroma of the products. However, with prior art vacuum storage systems of this type it is often not possible for the user to ascertain whether the desired vacuum is still present in the storage container. In addition, it can be difficult to maintain an adequate vacuum in the storage container, particularly over a prolonged period of time.

SUMMARY

Applicants have provided for a lid for a storage container which provides a user with a visible vacuum-pressure indicating nipple to readily determine whether a substantial/undesirable level of vacuum has been lost in the storage container. The lid is also provided with a pressure release valve containing a sheath. The sheath reduces any vacuum loss that can occur over time.

There is provided herein a lid for a vacuum storage container, the lid comprising:

a lid body having a top side and an opposing bottom side, a vacuum pressure-indicating nipple on the top side having a pressurized position and an unpressurized position, wherein the nipple is able to be drawn into the lid body into the pressurized position when the bottom of the lid body is exposed to a vacuum and returned to the unpressurized position upon release of the vacuum, the nipple having an upper length portion having a first color corresponding to the pressurized position, and a lower length portion having a second color corresponding to the unpressurized position.

There is also provided herein, a lid for a vacuum storage container, the lid comprising:

a lid body having a top side and an opposing bottom side, a collar on the bottom side having an open end, a pressure-release valve having a vacuum-sealed position and a vacuum-release position, the pressure-release valve extending from the top side into the collar on the bottom side and wherein when the pressure release valve is in the vacuum-sealed position the vacuum is maintained and when the pressure-release valve is in the vacuum-released position the vacuum is released; and, a sheath covering the open end of the collar on the bottom side, which sheath reduces a vacuum loss when the pressure-release valve is in the vacuum-sealed position while permitting a release of vacuum when the pressure-release valve is in the vacuum-release position.

BRIEF DESCRIPTION OF THE DRAWINGS

Various embodiments are described below with reference to the drawings wherein.

Like reference numerals indicate similar parts throughout the figures.

DETAILED DESCRIPTION OF PREFERRED EMBODIMENT(S)

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

Figure 1:
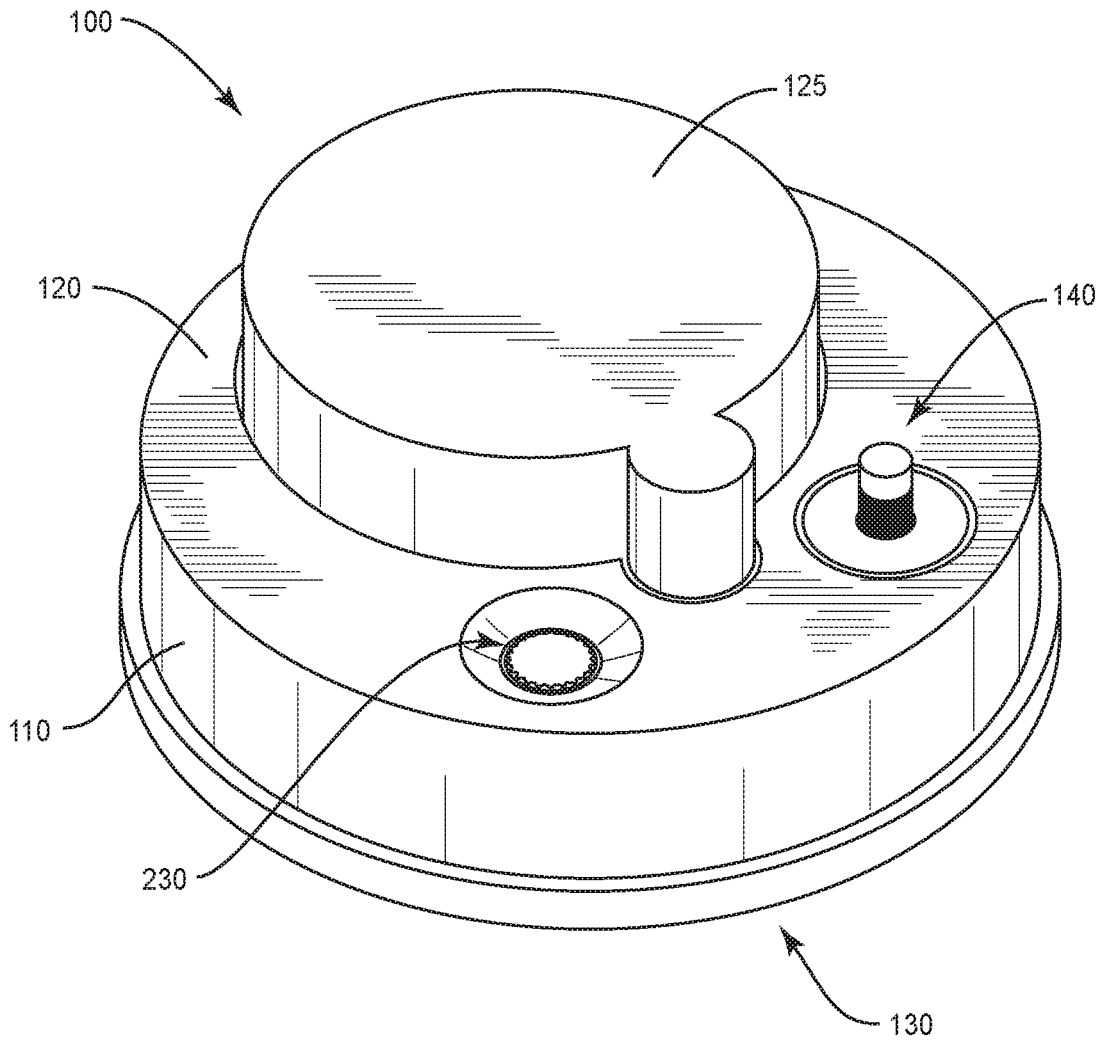
FIG. 1 is a top view of the lid for a storage container.

Referring to FIG. 1, there is provided a lid 100 for a vacuum storage container which comprises a lid body 110 having a top side 120 and a bottom side 130. The lid 100 also comprises a vacuum pressure-indicating nipple 140 located on the top side 120. The lid 100 contains a bellows 125 for producing a vacuum in a container 126 (see FIGS. 3 and 8A-8E) to which lid 100 is affixed to and then evacuated using said bellows 125.

Figure 2A:
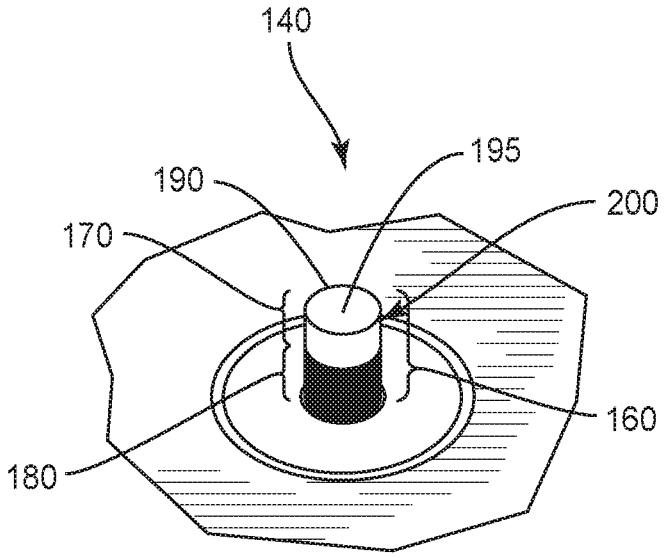
FIGS. 2A and 2B are close-up views of the vacuum pressure-indicating nipple.
Figure 2B:
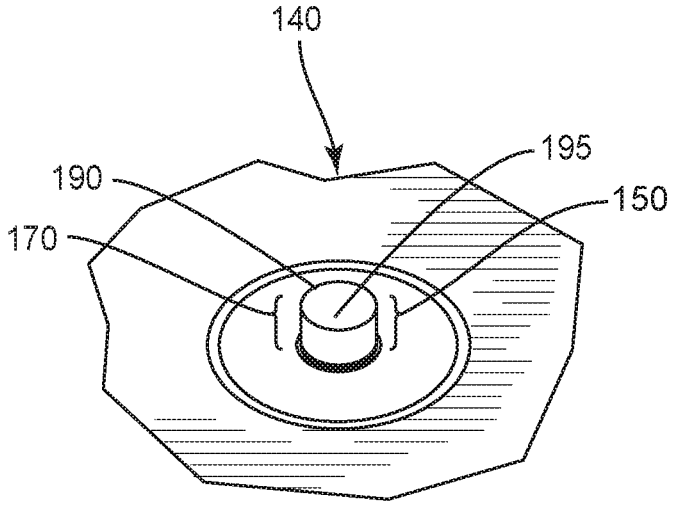

Referring to FIGS. 2A and 2B, the vacuum pressure-indicating nipple 140 has a pressurized position 150 (FIG. 2B) and an unpressurized position 160 (FIG. 2A). In one embodiment, the vacuum pressure-indicating nipple 140 has an upper length portion 170 which has a first color, which corresponds to the pressurized position 150. The vacuum pressure-indicating nipple 140 has a lower length portion 180 corresponding thereto and having a second color which is different from the first color, which is visible in an unpressurized position 160.

The first color of the upper length portion 170 extends from an upper surface 190 of the top 195 of the vacuum pressure-indicating nipple 140, up to about one half of a full length of the vacuum pressure-indicating nipple 140. Preferably the first color of the upper length portion 170 extends from an upper surface 190 of the top 195 of the vacuum pressure-indicating nipple 140, up to about one third of a full length of the vacuum pressure-indicating nipple 140. More preferably the first color of the upper length portion 170 extends from an upper surface 190 of the top 195 of the vacuum pressure-indicating nipple 140, up to about one quarter of a full length of the vacuum pressure-indicating nipple 140. In one embodiment, the upper length portion 170 can be from 0.5 cm to about 6 cm, preferably from 1 to about 3 cm.

The second color of the lower length portion 180 extends from a length position located just beneath the upper surface 190 of the top 195, (as is indicated by reference numeral 200 in FIG. 2A) of the vacuum pressure-indicating nipple and up to and including the full length of the vacuum pressure-indicating nipple 140. Preferably, the second color of the lower length portion 180 extends from about ⅓ of the length of the vacuum pressure-indicating nipple beneath the surface 195 and up to and including the full length of the vacuum pressure-indicating nipple 140. More preferably, the second color of the lower length portion 180 extends from about ¼ of the length of the vacuum pressure-indicating nipple beneath the surface 195 and up to and including the full length of the vacuum pressure-indicating nipple 140. In one embodiment, the lower length portion 180 can be from 0.5 cm to about 6 cm, preferably from 1 to about 3 cm.

The vacuum pressure-indicating nipple 140 allows a user of the lid 100 in conjunction with a container (shown in FIGS. 3 and 8A-8E) of the vacuum storage container to quickly and visually detect whether there has been any substantive loss of vacuum pressure in the vacuum storage container. In addition, the pressure-indicating nipple 140 also optionally allows a user to determine the relative degree of such loss of pressure through a visual approximation of the level of vacuum loss and its proximity to a complete loss of vacuum in the storage container. This is accomplished by a visual scan by the user of the color of the visible portion of the vacuum pressure-indicating nipple 140. Such a visual scan allows a user to determine if the storage container has entered a level of a substantive loss of pressure. This is possible if the length of the nipple 140 is bicolored. However, alternatively, the nipple 140 can employ a color gradient, as described herein below. The specific color in the gradient can indicate to a user whether a sufficient loss of pressure which would warrant re-pressurization of the vacuum storage container has occurred.

If there is sufficient vacuum in the interior of the storage container 126, the vacuum pressure-indicating nipple 140 is retained in a drawn-in position as relates to the lid body 110, i.e., toward an interior thereof. The vacuum pressure-indicating nipple 140 can accomplish this by being in a folded or snapped-in condition, and as described herein below and shown in FIGS. 8A-8E. In this state, vacuum pressure-indicating nipple 140 either does not project at all beyond the outer contour of the top side 120 of lid body 110, or else projects beyond the outer contour by a negligible amount, e.g., less than about 0.5 cm.

A user can first inform himself about the pressure status in a storage container interior which is covered by the lid 100 herein, by checking the position of vacuum pressure-indicating nipple 140 when lid 100 is closed. If the vacuum pressure-indicating nipple 140 projects out through the top side 120 beyond the upper length portion having a first color 170, thus, making second color 180 visible, then the pressure in the container interior may be insufficient for guaranteeing the storage of the product(s) therein under suitable vacuum conditions.

Bellows 125 as shown in FIG. 1 can be used to evacuate air from the storage container in a manner as is well known to those skilled in the art and in one embodiment as is shown in FIGS. 8A-8E.

When an equalization of pressure occurs over time in the storage container, vacuum pressure-indicating nipple 140, protrudes through the top side 120 of lid body 110. In addition, if the storage container is to be ventilated, i.e., the vacuum is to be released, the pressure-release valve 230 can be used to evacuate the container. After ventilation, lid 100 can easily be lifted off from the underlying container.

The first color of the vacuum pressure-indicating nipple 140 can be of any desired color, but can in one embodiment be the same color as the top side 120 of the lid body 110. To provide for the ability to conduct an easy visual scan by the user as described above, the second color can be of a color which is different from the first color. Preferably, the upper length first color portion 170 can be a non-alarming color such as the non-limiting examples of white, green, blue, transparent, or the like. The lower length portion second color 180 can be of a more alarming color such as the non-limiting examples of red, pink, orange, yellow, or the like. More preferably, the first color is green and the second color is red.

Figure 3:
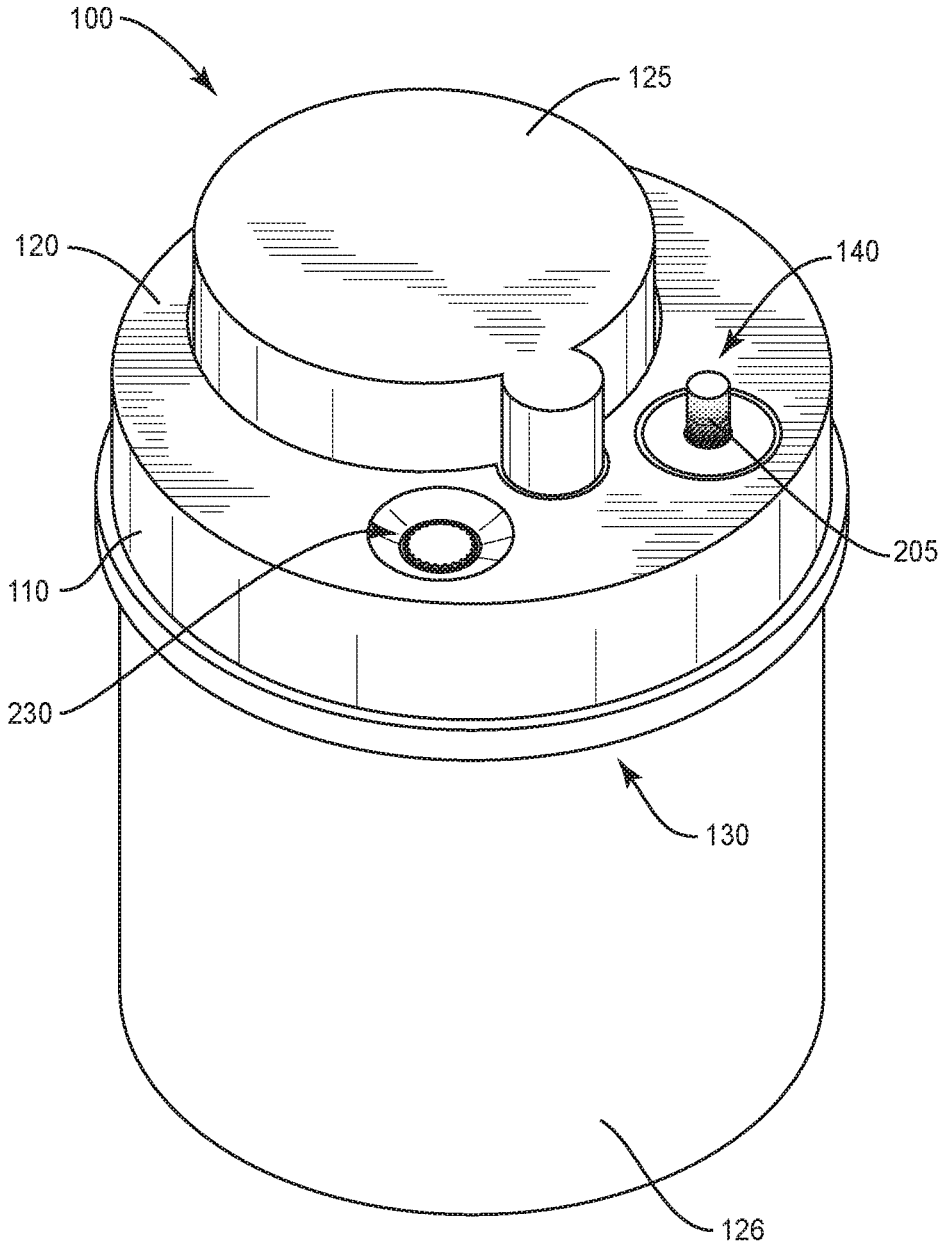
FIG. 3 is top view of the lid attached to a storage container wherein the nipple contains a color gradient thereon.
Figure 4:
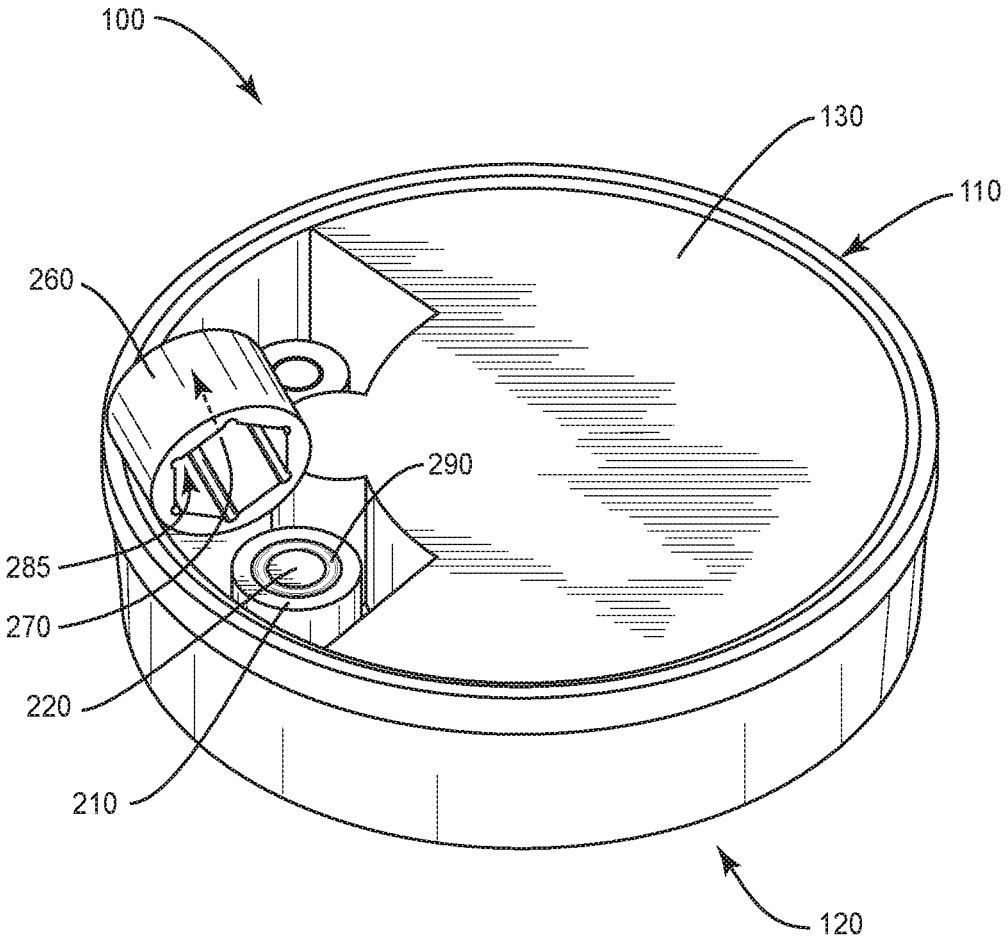
FIG. 4 is a view of the bottom side of the lid for a storage container.

Referring to FIG. 3, in one specific embodiment herein, the length of the vacuum pressure-indicating nipple 140 can be colored in a color gradient 205 going from aforementioned first color to the second color, and optionally going through intermediary colors therebetween. Such color gradients 205 will be known to those skilled in the art. In one non-limiting embodiment, the color gradient can range from green to red, going through a range of colors therebetween, such as, for example, starting with a first color green, then proceeding to blue, violet, orange yellow, pink and then ending in a second color of red. It is be understood that any color gradient 205 of any specific colors can be employed. The progression through the gradient colors can be stark from color to color. Alternatively, the colors can be present in a uniform blended manner, wherein there is no clear distinction between a preceding color and the next color in the color gradient 205. The use of such a gradient will be discernible from a visual observation of a user, as a general progression of colors.

Referring to FIGS. 4-7, the bottom side 130 of the lid body 110 illustrates the presence of a collar 210, which has an open end 220. The open end 220 can be of any shape, size or configuration which can or cannot be dimensioned in kind with the shape or dimensions of the collar 210. In one specific embodiment, the collar 210 is of a column shape, and the open end 220 is of a circular shape. The collar 210 on the bottom side 130 can have a sheath 260 placed thereon, which sheath has an interior surface 270 therein. The sheath 260 can cover the open end 220 of the collar 210 located on the bottom side 130 of the lid body 110. The sheath 260 can function to reduce a loss of vacuum in the storage container over time by preventing any negligible release of air through the pressure release valve 230 on top side 120 which may occur due to any unintended defective operation of pressure release valve, e.g., deterioration of, or poor fitting of an O-ring seal 290 on the open side of the collar 210. The interior surface 270 of the sheath 260 has an interior geometric dimension 285, e.g., an interior geometric shape, which accommodates and fits over the collar 210. For example, referring to FIGS. 6 and 7, there are shown a hexagonal and an octagonal shape, respectively, which are non-limiting examples of such interior geometric dimension(s) 285.

Figure 5:
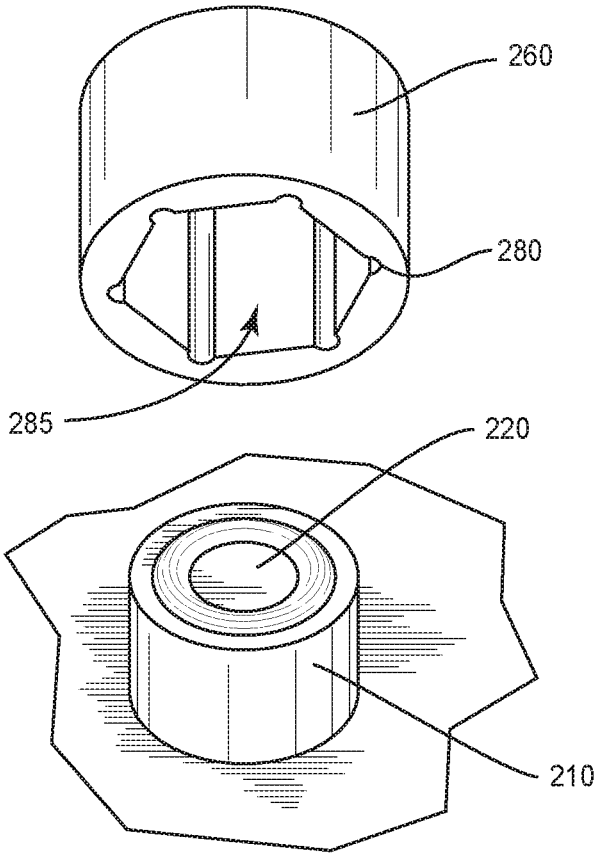
FIG. 5 is side view of the sheath and collar on the bottom sides of the lid.

Referring to FIG. 5, in one specific embodiment, the collar 210 is column-shaped, and the open end 220 of the collar 210 is circular and the sheath 260 has an interior dimension 285, which can be hexagonal.

Referring to FIGS. 1, 3, 4, and 5, the collar 210 on the bottom side 130 of lid body 110, can correspond to a pressure-release valve 230 located on the top side 120 of the lid body 110 (see FIG. 1). The pressure-release valve 230 can extend from the top side 120 into the collar 210 on the bottom side 130, as described herein below. The pressure-release valve 230 can have a vacuum-sealed position and an opposing vacuum-released position (not shown). A person of ordinary skill in the art will be able to provide and employ such positions. The pressure, in the vacuum-storage container 126 having the lid 100 affixed thereto can be released by opening (i.e., e.g., by depression) of the pressure-release valve 230 as shown in FIG. 8E. Upon release of the depression of the pressure-release valve 230 from the vacuum-released position, the pressure-release valve 230 immediately returns to the vacuum-sealed position.

Referring to FIGS. 1, 3, and 8A-8E, the pressure in the vacuum storage container 126, when the lid 100 is thereon can range from about −10 mbar to about −1,000 mbar, preferably from about −50 mbar to about −750 mbar, and most preferably from about −100 mbar to about −500 mbar, with each of said ranges being measured at 25° C. The pressure in the vacuum storage container 126 can be produced by pushing the air out of the container 126 using the bellows 125 located on the top surface 120 of the lid body 110. The bellow 125 works with a mechanism located within the lid body 110, which is described below with regard to FIGS. 8A-8E.

In one specific embodiment herein, the collar 210, the length of the pressure-release valve 230, and the sheath 260 can each be configured in such a manner that a depression of the pressure release valve 230 on the top side 120 of the lid body 110, pushes the length of the pressure release valve 230 through a length of the collar 210 on the bottom side 130 of the lid body 110, and into an interior top surface 270 of the sheath 260. This depression action in turn pushes the bottom of the sheath 260 to a position closer to the open end 220 of the collar 210 to allow for an increased rate of pressure release through the pressure-release valve 230.

In another embodiment, the length of the pressure release valve 230 is not of such a length that it would allow the pressure release valve 230, when depressed by a user to contact the interior top surface 270 of the sheath 260. Regardless of which embodiment is employed, the sheath 260 provides for a reduced level of vacuum loss from the vacuum pressure-release valve that occurs over time.

After depression of the pressure-release valve 230 to a vacuum-release position, and a removal of the lid 100, a user may then push the sheath 260 back onto the full length of the collar 210 such that its interior surface 270 is in a position to be contacted by the pressure-release valve 230 in the future.

Figure 6:
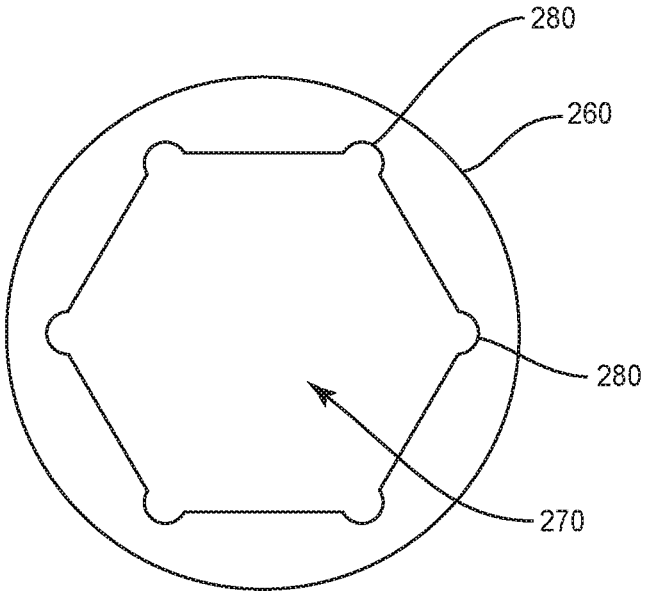
FIG. 6 is a bottom view of a hexagonal dimension of the interior of the sheath.
Figure 7:
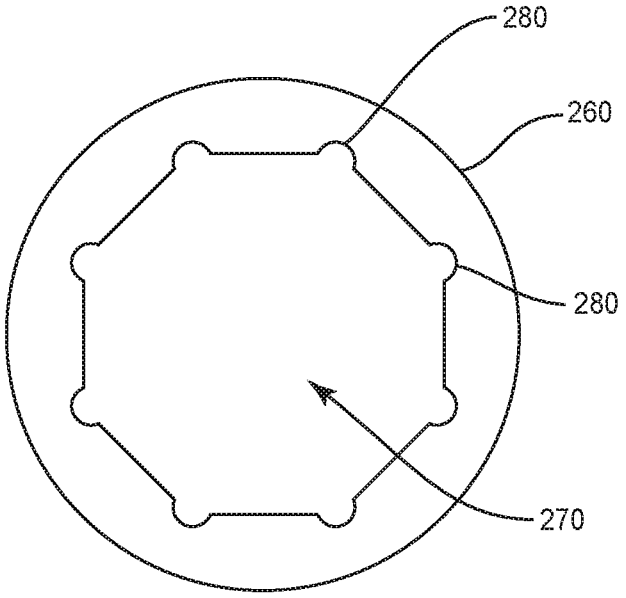
FIG. 7 is a bottom view of an octagonal dimension of the interior of the sheath.

Referring to FIGS. 5-7, while not wishing to be bound by theory, the sheath 260 has geometric dimensions 285, e.g., a hexagon, which contains divot(s) 280 located at each junction of two sides of the geometric dimension 285, e.g., at each corner of a hexagon, which divots 280 permit a release of vacuum when the pressure-release valve 230 is in the vacuum release position. In addition, the use of the sheath 260 allows for a reduction in vacuum loss that may occur over time through the vacuum release valve 230 due to unintended leaks and/or deterioration of the sealing properties of the vacuum release valve 230. In one non-limiting embodiment such a reduction in vacuum loss can be at least a 10% reduction, preferably at least a 25% reduction, and up to about a 100% and preferably up to about 500% reduction in loss of vacuum as compared to an identical vacuum storage container containing the lid 100 which does not contain a sheath 260.

In general operation of the lid 100, when attached to the vacuum storage container 126 the container is vacuum pressurized by the use of bellows 125. Such vacuum pressurization causes the vacuum pressure-indicating nipple to become substantially level or negligibly above the contour of the top side 120 of the lid body 110. In such a position, the vacuum pressure-indicating nipple 140 only has an upper surface 190 of the top 195 of the vacuum pressure-indicating nipple 140 shown to a user. Over a period of time, which can vary from 1 hour to a month, preferably 1 day to two weeks, and most preferably from 1 day to 1 week, a user can visually scan the vacuum storage container and discern from the color of the vacuum pressure-indicating nipple 140 if an undesirable level of vacuum pressure has been lost in the container. Such is determined either by a visibility of the second portion color 180, or an undesirable color in a pre-arranged color gradient as described above. In the event a user desires to remove the contents of the container, a user can depress the pressure-release valve 230 to a vacuum-release position. Upon release of vacuum, the user can then open the container, and if necessary, move the sheath 260 such that its inner surface 270 contacts the bottom of the pressure-release valve 230, such as is described above. Such a process can then be repeated as desired.

Figure 8A:
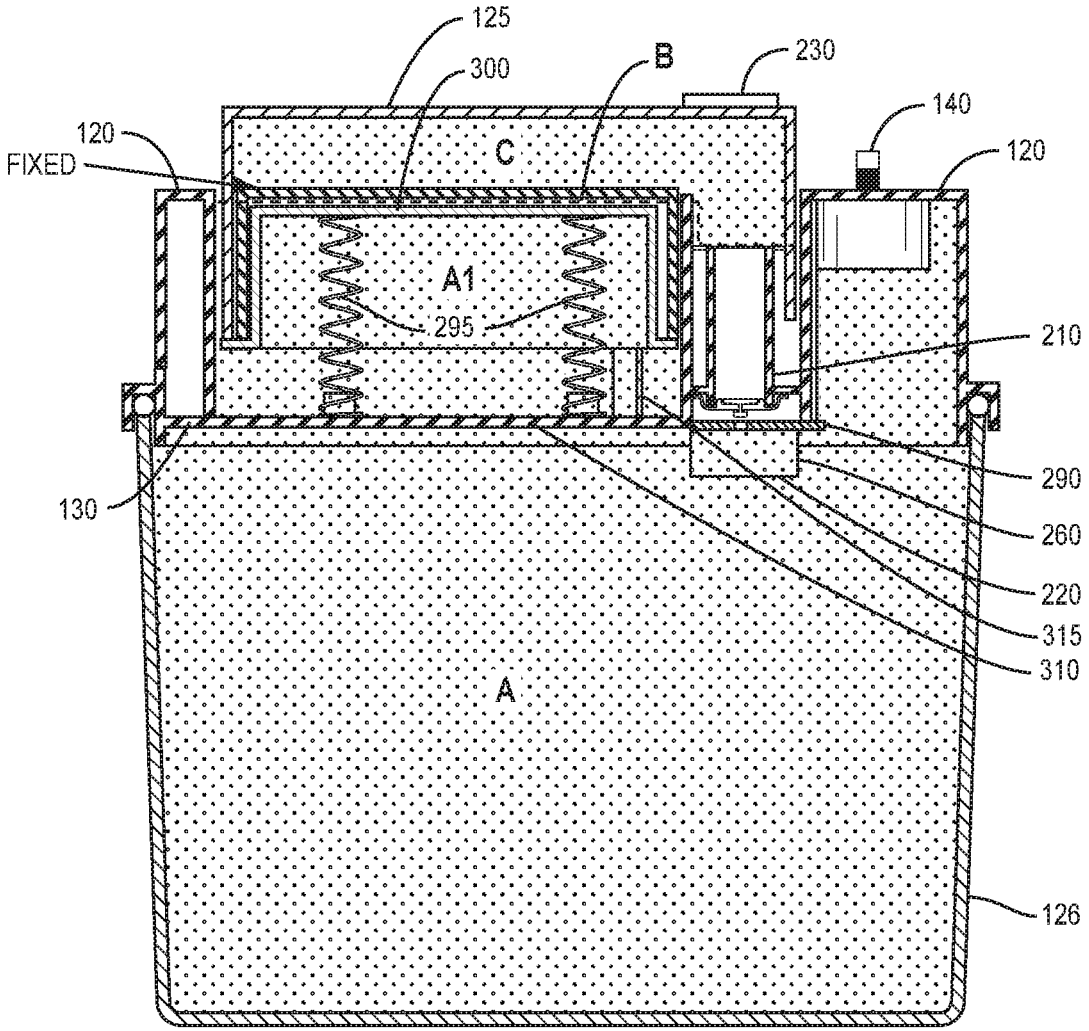
FIGS. 8A-8E are schematic views depicting the operation of the lid when attached to a storage container.
Figure 8B:
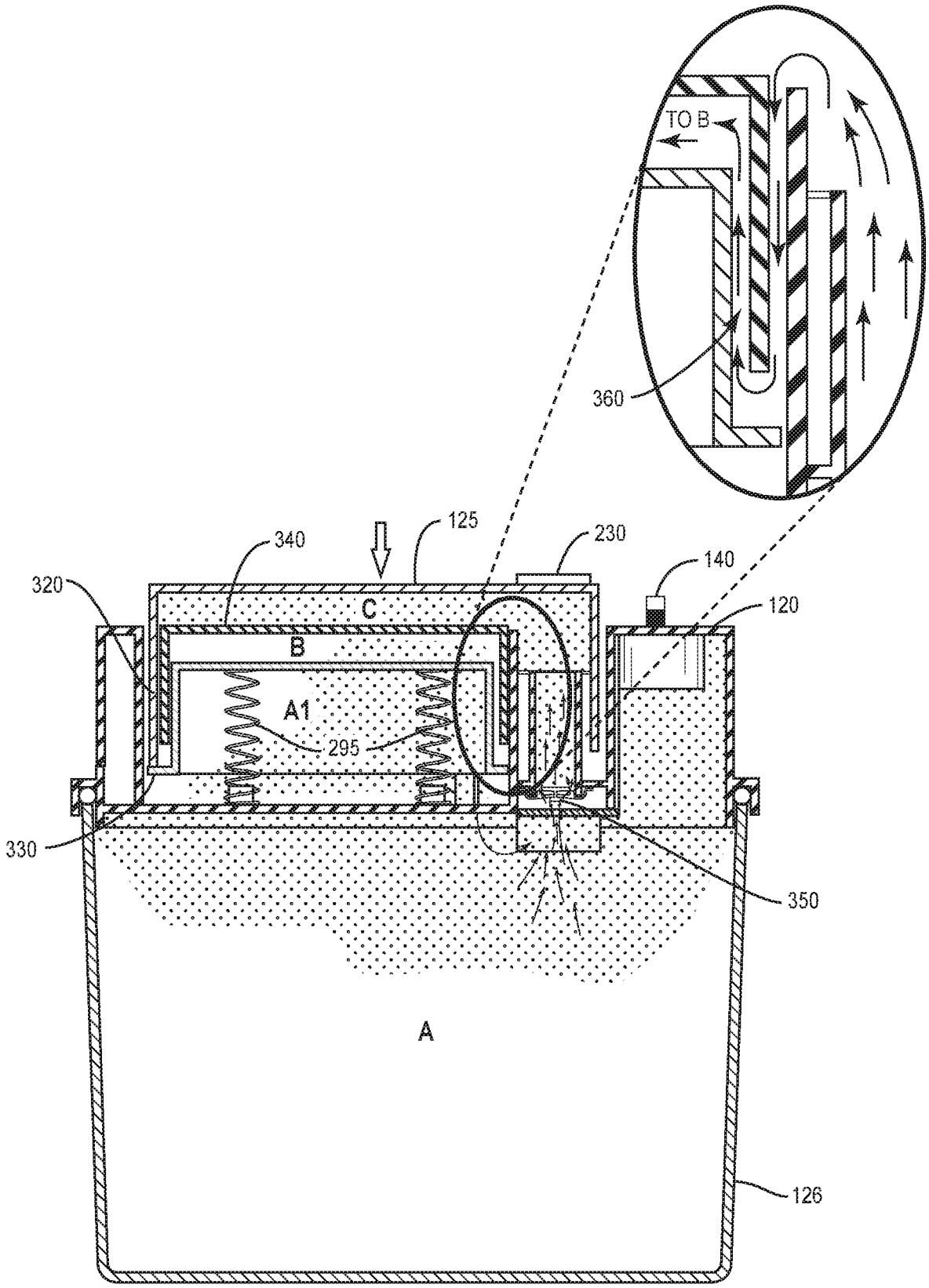
Figure 8C:
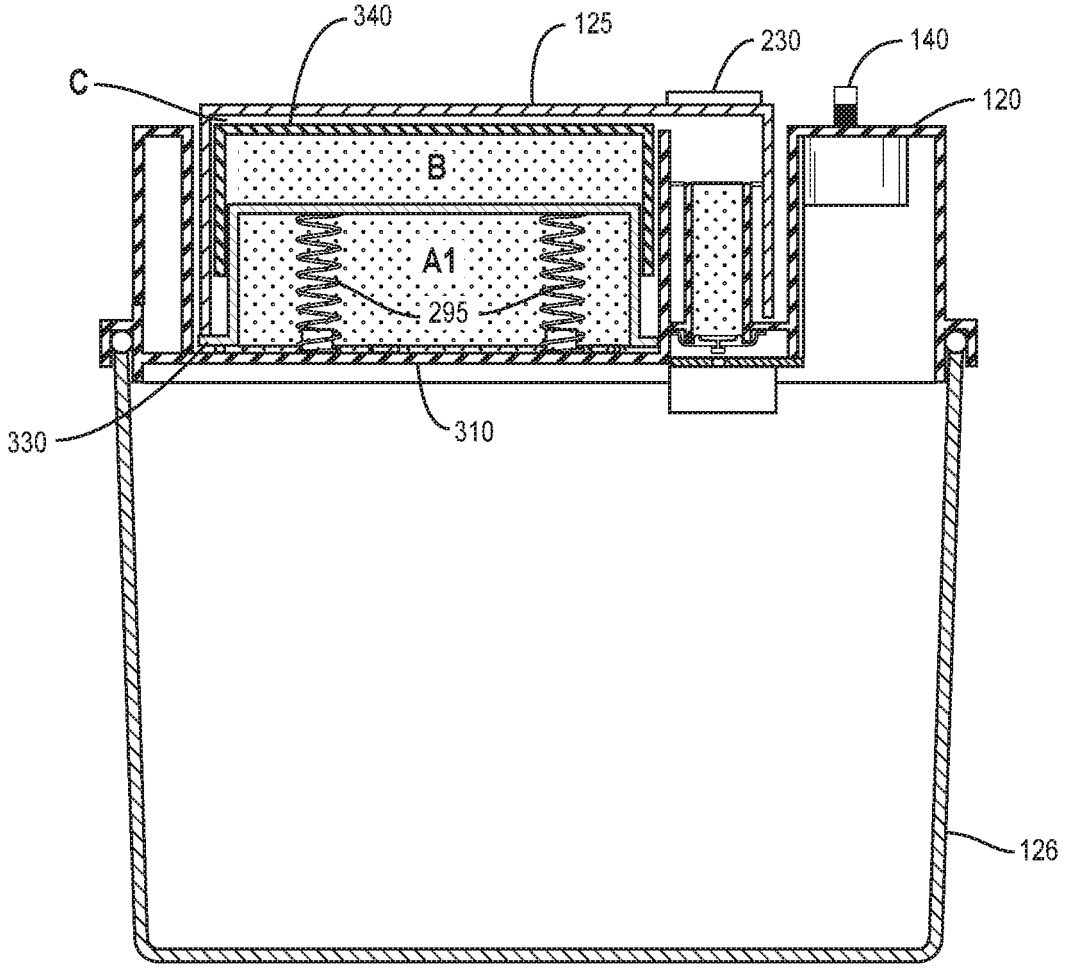
Figure 8D:
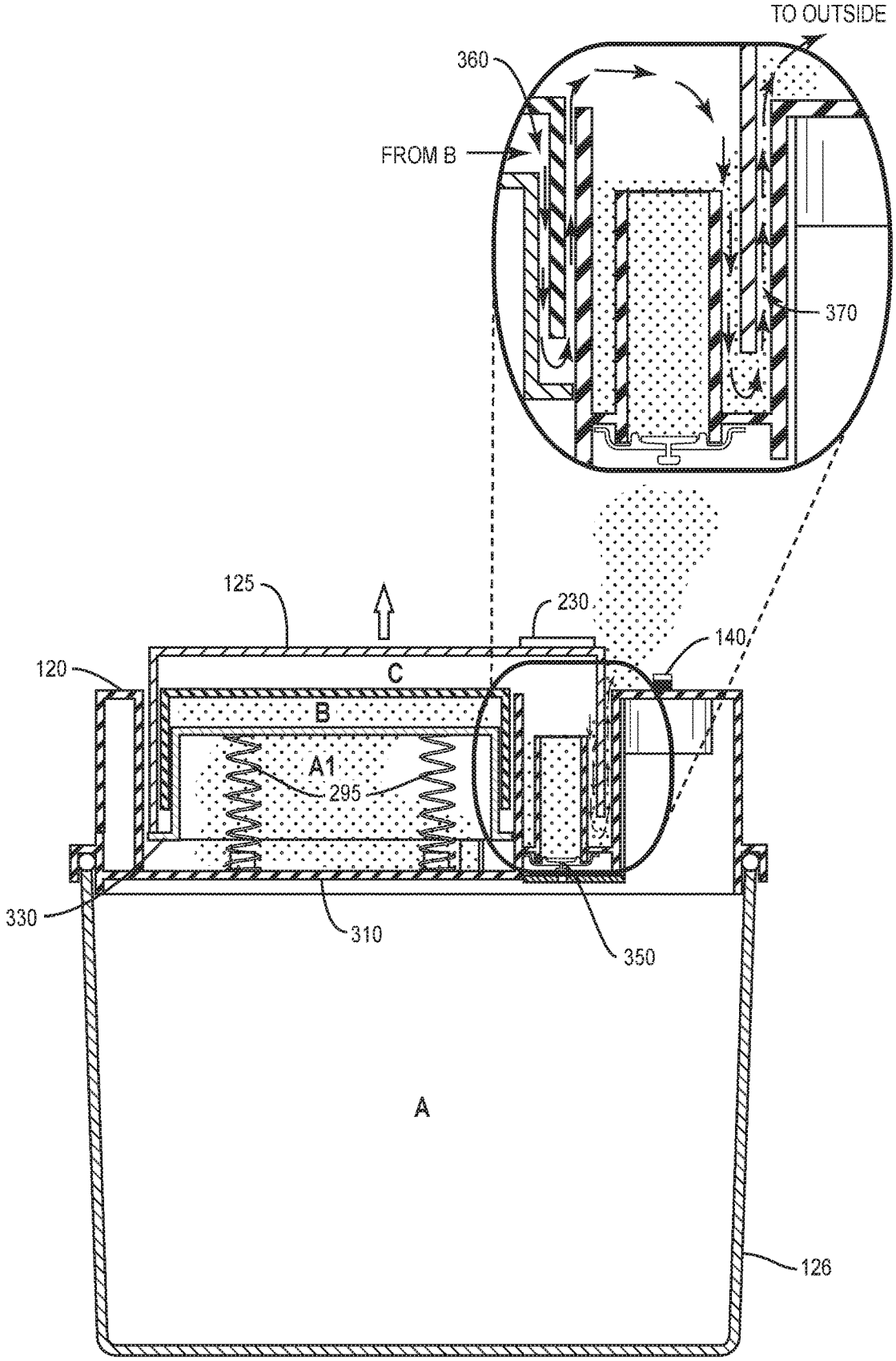
Figure 8E:
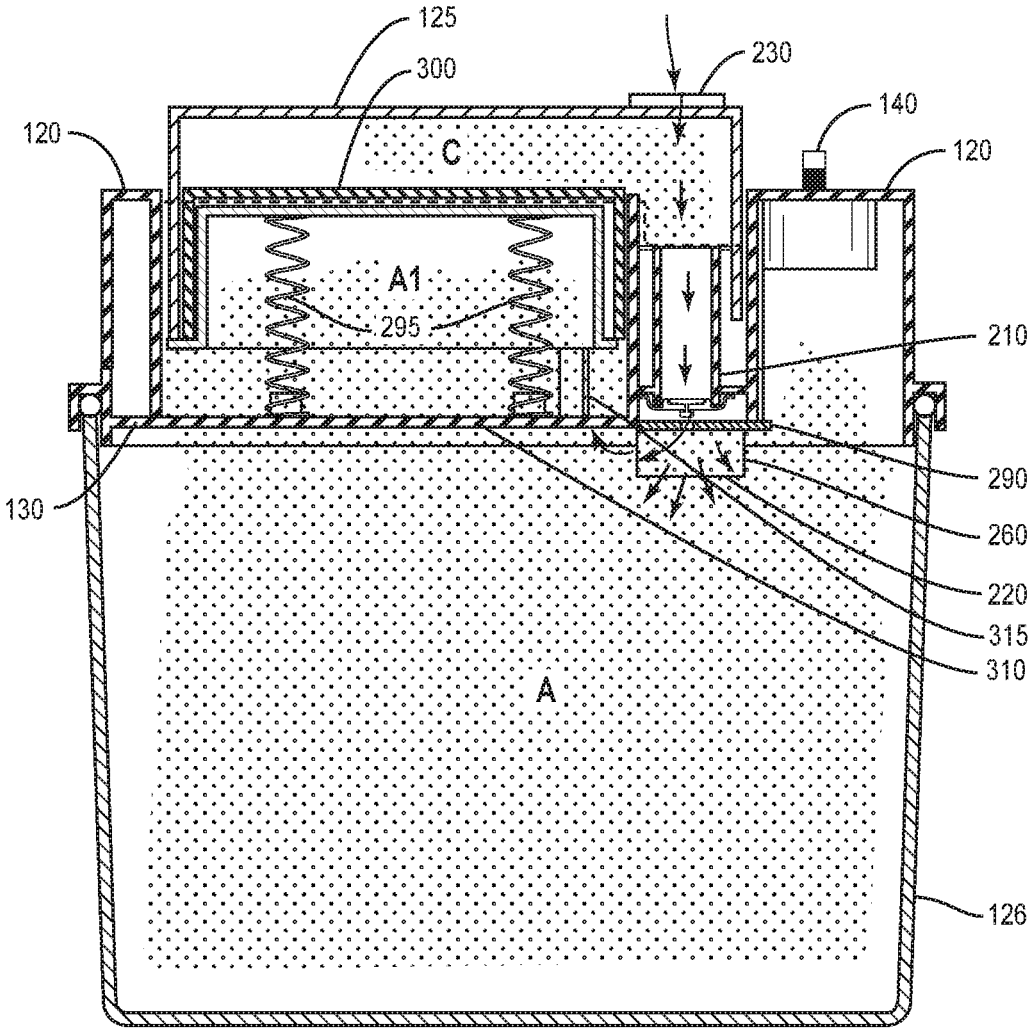

Referring to FIGS. 8A-8E which show a progressive general schematic depiction of the operation of the lid 100 when attached to a vacuum storage container 126. Starting from FIG. 8A, the container 126 has a chamber A, and the bellows 125 of lid 100 have three separate chambers, chamber A1, chamber B (shown in place by the dashed line) and chamber C. In an unpressurized state, i.e., when vacuum pressure-indicating nipple 140 is in an unpressurized position 160, the bellows 125 has chamber B in its minimum volume position (indicated by dashed line), i.e. the chamber is in a minimum volume position due to the presence of springs 295 which support an upper portion 300 of chamber A1 when springs 295 are in their fully extended state as shown in FIG. 8A. The lid 100 also is depicted in FIG. 8A to contain the pressure release valve 230 (shown in an elevated state for purposes of identifying its location) on the top 120 thereof which runs through the lid body 110 to the bottom side 130 to provide for the collar 210 which can be covered by sheath 260 over the open end 220 to avoid any unintentional loss of vacuum through the O-ring seal 290 found on the open end 220. The chamber A1 also contains a bottom 310 which has an opening 315 therein which is capable of communicating air from chamber A1 to chamber A. FIG. 8A depicts the lid 100 attached to container 126 in an unpressurized state (e.g., when there is an air equilibrium between chamber A and chamber A1), or in a less than fully pressurized state.

Referring to FIG. 8B, a user (not shown) can depress the top of the bellows 125 of lid 100 in the direction indicated by the arrow. The bellows 125 has on one side 320 of the bellows 125 a lip of chamber A1 330 which is depressed when the top of bellows 125 is depressed and which action compresses the springs 295 in chamber A1 accordingly. The chamber B in lid 100 has a casing 340 which is fixed in place and does not move with the action of compression of bellows 125 so noted, and thus, due to the depression of bellows 125, which compresses the springs 295, the volume of chamber A1 is decreased and the volume of chamber B is increased from that shown in FIG. 8A.

This transference of volume of air (shown by dotted portion) results in a change in pressure in chamber A. The compression of bellows 125 and the decrease in volume of chamber A1 forces air out of chamber A1 through opening 315 in chamber A1 and into chamber A. Boyles Law, states that Pressure=Volume×Temperature, thus, at a static temperature, when bellows 125 is compressed, and the volume of chamber A1 decreases, and the volume of chamber A must increase, in order to maintain an equilibrium in pressure, the increased volume of air, which is forced through the opening 315 into chamber A, then passes into the open end of collar 220 through a check valve 350, and then through an entrance/escape path 360 into chamber B as indicated by the arrows in FIG. 8B. It can be seen in FIG. 8B that the volume of chamber C has decreased due to the partial depression of bellows 125 as compared to the volume of chamber C in FIG. 8A wherein the bellows are in a static uncompressed state.

Referring to FIG. 8C, this figure depicts when chamber B reaches a maximum capacity. Such a maximum capacity is achieved when bellows 125 is fully depressed through the pressing of lip 330 of chamber A1 and springs 295 are at their maximum compression position due to the pressing of bellows 125. In kind, since chamber B has reached full volume capacity, and chamber A1 has reached the minimum volume capacity due to contact of lip 330 with the bottom 310 of chamber A1, the volume of chamber C has also achieved minimum volume capacity. It is to be noted that there is no means of air communication between chamber A1 and chamber B, thus, allowing for the noted differences in volumes thereof.

Referring to FIG. 8D, this figure depicts what occurs when the bellows 125 is released from depression by the user as shown by the arrow above bellows 125. The inverse actions of those depicted in FIGS. 8A-8C then occur. Stated more specifically, the removal of pressure by the user on the bellows 125 results in the springs 295 returning to their initial uncompressed state as depicted in FIG. 8A. Since there is no more downward pressure on the lip 330, the release of the compression of the springs 295 causes the volume of chamber A1 to increase and the volume of chamber C to likewise increase as air passes from chamber B through entrance/escape path 360 in the reverse direction depicted in FIG. 8B into chamber C. The air then passes from chamber C through an evacuation path 370 and out of the top of lid 100 as indicated by the arrows. The release of pressure on bellows 125 and the above described movement of air from chamber B into the atmosphere outside of lid 100, and the increase in the volume of chamber A1, and the decrease in volume of chamber B, is again due to Boyles law, which produces a change in pressure in the container 126 under static temperature conditions due to volume change of the amount of air in lid 100, i.e., the release of air into the atmosphere outside of lid 100.

Since check valve 350 prevents the flow of air back into chamber A, and since chamber A1 and chamber A are in air communication through the opening 315, under Boyles Law of Pressure=Volume×Temperature, the increase in volume in A1, requires that the pressure in chamber A be decreased, i.e., that a vacuum be formed in the vacuum container 126 as compared to the pressure outside of container 126. The vacuum in pressure container 126 can be increased by repeatedly pumping bellows 125 as described herein and can achieve vacuum pressures such as those described herein above. With the initial depression of bellows 125, and each subsequent depression thereafter, the vacuum that is produced in vacuum container 126 causes the vacuum-pressure-indicating nipple to be drawn into the lid body 110 and thus reduce the height of the nipple 140 and provide for the indication of pressurized position 150 as described herein above.

Referring to FIG. 8E, the pressure-release valve 230 can function to release the vacuum that is formed in vacuum container 126. The opening of the pressure release valve 230 by turning it in a clockwise or counter-clockwise direction, either with or without depression results in the collar 210 being extended down as described above, and an opening of the check valve 350 to occur, which opening permits an equalization of pressure from outside the lid 100 and the interior of the vacuum container 126 to occur. Such equalization results in air moving in the direction of arrows depicted in FIG. 8E. The depressurization of the vacuum container, then allows for removal of the lid 100 and access to any contents of the container 126 therein.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

Where this application has listed the steps of a method or procedure in a specific order, it may be possible, or even expedient in certain circumstances, to change the order in which some steps are performed, and it is intended that the particular steps of the method or procedure claim set forth herein below not be construed as being order-specific unless such order specificity is expressly stated in the claim. Any of the structure, components, methods or procedures described herein can be used by any user in the manner described herein.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

The invention claimed is:

1. A sheath dimensioned to attach to a pressure relief valve of a lid for a vacuum storage container, wherein a length of the pressure release valve and the sheath are configured such that a depression of the pressure release valve pushes a bottom portion of the length of the pressure release valve into an interior top surface of the sheath to allow for pressure release through the pressure release valve.

2. A lid for a vacuum storage container, the lid comprising:

a lid body having a top side and an opposing bottom side, a collar on the bottom side having an open end, a pressure-release valve having a vacuum-sealed position and a vacuum-release position, the pressure-release valve extending from the top side into the collar on the bottom side and wherein when the pressure release valve is in the vacuum-sealed position the vacuum is maintained and when the pressure-release valve is in the vacuum-released position the vacuum is released; and, a sheath covering the open end of the collar on the bottom side, which sheath reduces a vacuum loss when the pressure-release valve is in the vacuum-sealed position while permitting a release of vacuum when the pressure-release valve is in the vacuum-release position and, where the collar, a length of the pressure-release valve, and the sheath are configured in a manner such that a depression of the pressure-release valve on the top of the lid pushes a length of the pressure-release valve through a length of the collar and into an interior surface of the sheath, which in turn, pushes the sheath to a lower position over the collar to allow for an increased rate of pressure release through the pressure-release valve.

3. The sheaf of claim 1, wherein the sheath contains an internal geometric dimension which contains divots located at each junction of two sides of the internal geometric dimension.

4. A lid for a vacuum storage container, the lid comprising:

a lid body having a top side and an opposing bottom side, a vacuum pressure-indicating nipple on the top side having a pressurized position and an unpressurized position, wherein the nipple is able to be drawn into the lid body into the pressurized position when the bottom of the lid body is exposed to a vacuum and returned to the unpressurized position upon release of the vacuum, the nipple having an upper length portion having a first color corresponding to the pressurized position, and a lower length portion having a second color corresponding to the unpressurized position, and, the sheath of claim 1.

5. The lid of claim 4, where the first color extends from an upper surface of a top of the vacuum pressure-indicating nipple up to about one half of a full length of the vacuum pressure-indicating nipple.

6. The lid of claim 4, where the second color extends from a length position located beneath an upper surface of the top of the vacuum pressure-indicating nipple up to the full length of the vacuum pressure-indicating nipple.

7. The lid of claim 4, where the first color is a color matching the color of the top side of the lid body and the second color is different from the first color.

8. The lid of claim 4, where the first color changes via a color gradient to the second color along the length of the vacuum pressure-indicating nipple.

9. The lid of claim 4, where the first color is green and the second color is red.

10. The lid of claim 4, where the collar is column-shaped and the collar opening is circular, and the sheath has an interior geometric dimension which accommodates and fits over the column-shaped collar.

11. The lid of claim 10, where the interior geometric dimension of the sheath is a hexagon which contains a divot at each junction of two sides of the hexagon.

* * * * *